US009048064B2

(12) United States Patent
Boye et al.

(10) Patent No.: US 9,048,064 B2
(45) Date of Patent: Jun. 2, 2015

(54) CATHODE ASSEMBLY FOR A LONG THROW LENGTH X-RAY TUBE

(71) Applicant: Varian Medical Systems, Inc., Palo Alto, CA (US)

(72) Inventors: James Russell Boye, Salt Lake City, UT (US); Colton Bridger Woodman, West Valley City, UT (US); Todd S. Parker, Kaysville, UT (US)

(73) Assignee: VARIAN MEDICAL SYSTEMS, INC., Palo Alto, CA (US)

( * ) Notice: Subject to any disclaimer, the term of this patent is extended or adjusted under 35 U.S.C. 154(b) by 270 days.

(21) Appl. No.: 13/786,272

(22) Filed: Mar. 5, 2013

(65) Prior Publication Data

US 2014/0254767 A1 Sep. 11, 2014

(51) Int. Cl.
*H01J 35/14* (2006.01)

(52) U.S. Cl.
CPC ..... *H01J 35/14* (2013.01); *H01J 2235/06* (2013.01)

(58) Field of Classification Search
CPC ..... H01J 35/02; H01J 35/04; H01J 35/06; H01J 35/065; H01J 35/14; H01J 35/30; H01J 35/305; H01J 2235/06; H01J 2235/062; H05G 1/30; G21K 1/08; G21K 1/087; G21K 1/093
See application file for complete search history.

(56) References Cited

U.S. PATENT DOCUMENTS 4,107,562 A * 8/1978 Koller et al. ..... 378/203
4,145,616 A * 3/1979 Tanabe ..... 378/150
4,629,933 A * 12/1986 Bijma et al. ..... 313/414
4,631,742 A * 12/1986 Oliver ..... 378/113
4,730,353 A * 3/1988 Ono et al. ..... 378/138
4,777,642 A * 10/1988 Ono ..... 378/138
5,812,632 A * 9/1998 Schardt et al. ..... 378/137
6,785,359 B2 * 8/2004 Lemaitre ..... 378/136
6,912,268 B2 * 6/2005 Price et al. ..... 378/122
7,409,043 B2 * 8/2008 Dunham et al. ..... 378/115
8,385,506 B2 * 2/2013 Lemaitre et al. ..... 378/136
8,588,372 B2 * 11/2013 Zou et al. ..... 378/113
2008/0043920 A1 * 2/2008 Liu et al. ..... 378/138
2009/0122961 A1 5/2009 Ohsawa
2009/0245468 A1 * 10/2009 Zou et al. ..... 378/122
2011/0142193 A1 6/2011 Frontera et al.
2011/0188637 A1 * 8/2011 Lemaitre et al. ..... 378/136
2013/0336461 A1 * 12/2013 Jeong et al. ..... 378/138
2014/0254767 A1 * 9/2014 Boye et al. ..... 378/136

OTHER PUBLICATIONS

International Search Report and Written Opinion dated Jun. 18, 2014 as received in PCT Application No. PCT/US2014/020777.

* cited by examiner

*Primary Examiner* — Thomas R Artman
(74) *Attorney, Agent, or Firm* — Maschoff Brennan

(57) ABSTRACT

Cathode assembly for a long throw length x-ray tube. In one example embodiment, a cathode assembly for an x-ray tube includes an electron emitter, an acceleration region, and a drift region. The electron emitter includes a curved emitting surface configured to emit an electron beam having a y-dimension that is greater than an x-dimension at the electron emitter. The acceleration region is defined adjacent to the electron emitter. The acceleration region is configured such that when the electron beam propagates within the acceleration region, the electron beam accelerates in a z-direction substantially normal to a midpoint of the curved emitting surface. The drift region is defined between the acceleration region and an anode. The drift region is configured such that the combined lengths of the drift region and the acceleration region are sufficient for the y-dimension to be less than the x-dimension at the anode.

20 Claims, 12 Drawing Sheets

CATHODE ASSEMBLY FOR A LONG THROW LENGTH X-RAY TUBE

BACKGROUND

1. Field

The embodiments described herein relate to x-ray tubes. In particular, some embodiments described herein relate to a cathode assembly for use in long throw length x-ray tubes.

2. Relevant Technology

X-ray tubes are used in a variety of industrial and medical applications. For example, x-ray tubes are employed in medical diagnostic examination, therapeutic radiology, semiconductor fabrication, and material analysis. Regardless of the application, most x-ray tubes operate in a similar fashion. X-rays, which are high frequency electromagnetic radiation, are produced in x-ray tubes by applying an electrical current to a cathode to cause electrons to be emitted from the cathode by thermionic emission. The electrons accelerate towards and then impinge upon an anode. The distance between the cathode and the anode is generally known as a throw length. When the electrons impinge upon the anode, the electrons can collide with the anode to produce x-rays. The area on the anode in which the electrons collide is generally known as a focal spot.

X-rays can be produced through at least two mechanisms that can occur during the collision of the electrons with the anode. A first x-ray producing mechanism is referred to as x-ray fluorescence or characteristic x-ray generation. X-ray fluorescence occurs when an electron colliding with material of the anode has sufficient energy to knock an orbital electron of the anode out of an inner electron shell. Other electrons of the anode in outer electron shells fill the vacancy left in the inner electron shell. As a result of the electron of the anode moving from the outer electron shell to the inner electron shell, X-rays of a particular frequency are produced. A second x-ray producing mechanism is referred to as Bremsstrahlung. In Bremsstrahlung, electrons emitted from the cathode decelerate when deflected by nuclei of the anode. The decelerating electrons lose kinetic energy and thereby produce x-rays. The x-rays produced in Bremsstrahlung have a spectrum of frequencies. The x-rays produced through either Bremsstrahlung or x-ray fluorescence may then exit the x-ray tube to be utilized in one or more of the above-mentioned applications.

In certain applications, it may be beneficial to lengthen the throw length of an x-ray tube. For example, a long throw length may result in decreased back ion bombardment and evaporation of anode materials back onto the cathode. While x-ray tubes with long throw lengths may be beneficial in certain applications, a long throw length can also present difficulties. For example, as a throw length is lengthened, the electrons that accelerate towards an anode through the throw length tend to become less laminar resulting in an unacceptable focal spot on the anode. When a focal spot in unacceptable, it may be difficult to produce useful x-rays.

The subject matter claimed herein is not limited to embodiments that solve any disadvantages or that operate only in environments such as those described above. Rather, this background is only provided to illustrate one exemplary technology area where some embodiments described herein may be practiced.

SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

In one example embodiment, a cathode assembly for an x-ray tube includes an electron emitter, an acceleration region, and a drift region. The electron emitter includes a curved emitting surface configured to emit an electron beam having a y-dimension that is greater than an x-dimension at the electron emitter. The acceleration region is defined adjacent to the electron emitter. The acceleration region is configured such that when the electron beam propagates within the acceleration region, the electron beam accelerates in a z-direction substantially normal to a midpoint of the curved emitting surface. The drift region is defined between the acceleration region and an anode. The drift region is configured such that the combined lengths of the drift region and the acceleration region are sufficient for the y-dimension to be less than the x-dimension at the anode.

In another example embodiment, an x-ray tube includes a cathode assembly and an anode. The cathode assembly includes an electron emitter and a cathode envelope. The electron emitter has a curved emitting surface which is configured to emit an electron beam having a y-dimension that is greater than an x-dimension at the electron emitter. The cathode envelope defines a drift region and an acceleration region. The acceleration region is positioned relative to the cathode assembly such that the electron beam enters the acceleration region and propagates through the acceleration region and then through the drift region. The anode is positioned opposite the cathode assembly at a terminal end of the drift region. The anode includes a target surface upon which the electron beam impinges to generate a focal spot. The focal spot has a y-dimension that is less than an x-dimension.

Another example embodiment includes a method of generating x-rays in an x-ray tube. The method includes emitting from a curved emitting surface an electron beam having a y-dimension that is greater than an x-dimension at the electron emitter. The method also includes accelerating the electron beam through an acceleration region of a volume between a cathode assembly and an anode. The method also includes drifting the electron beam through a drift region of the volume between the cathode assembly and the anode. The method also includes generating a focal spot representative of the electron beam by impinging the electron beam against a target surface of the anode. The focal spot has a y-dimension that is less than an x-dimension.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

A more particular description of the invention will be rendered by reference to specific embodiments thereof which are illustrated in the appended drawings. It is appreciated that these drawings depict only example embodiments of the invention and are therefore not to be considered limiting of its scope. These example embodiments will be described and explained with additional specificity and detail through the use of the accompanying drawings in which.

DESCRIPTION OF SOME EXAMPLE EMBODIMENTS

Reference will now be made to figures wherein like structures will be provided with like reference designations. It is understood that the drawings are diagrammatic and schematic representations of exemplary embodiments, and are not limiting of the present invention nor are they necessarily drawn to scale.

In general, example embodiments described herein relate to a cathode assembly for use in long throw length x-ray tubes. In at least some of the example embodiments disclosed herein, the difficulties associated with a long throw length of an x-ray tube can be overcome by employing an electron emitter having a curved emitting surface. The curved emitting surface produces an electron beam that is substantially laminar as it propagated through an acceleration region and a drift region to impinge upon a target surface of an anode. Additionally, in at least some example embodiments, the curved emitting surface results in the dimensions of the electron beam being substantially transposed between the electron emitter and the anode.

Figure 1A:
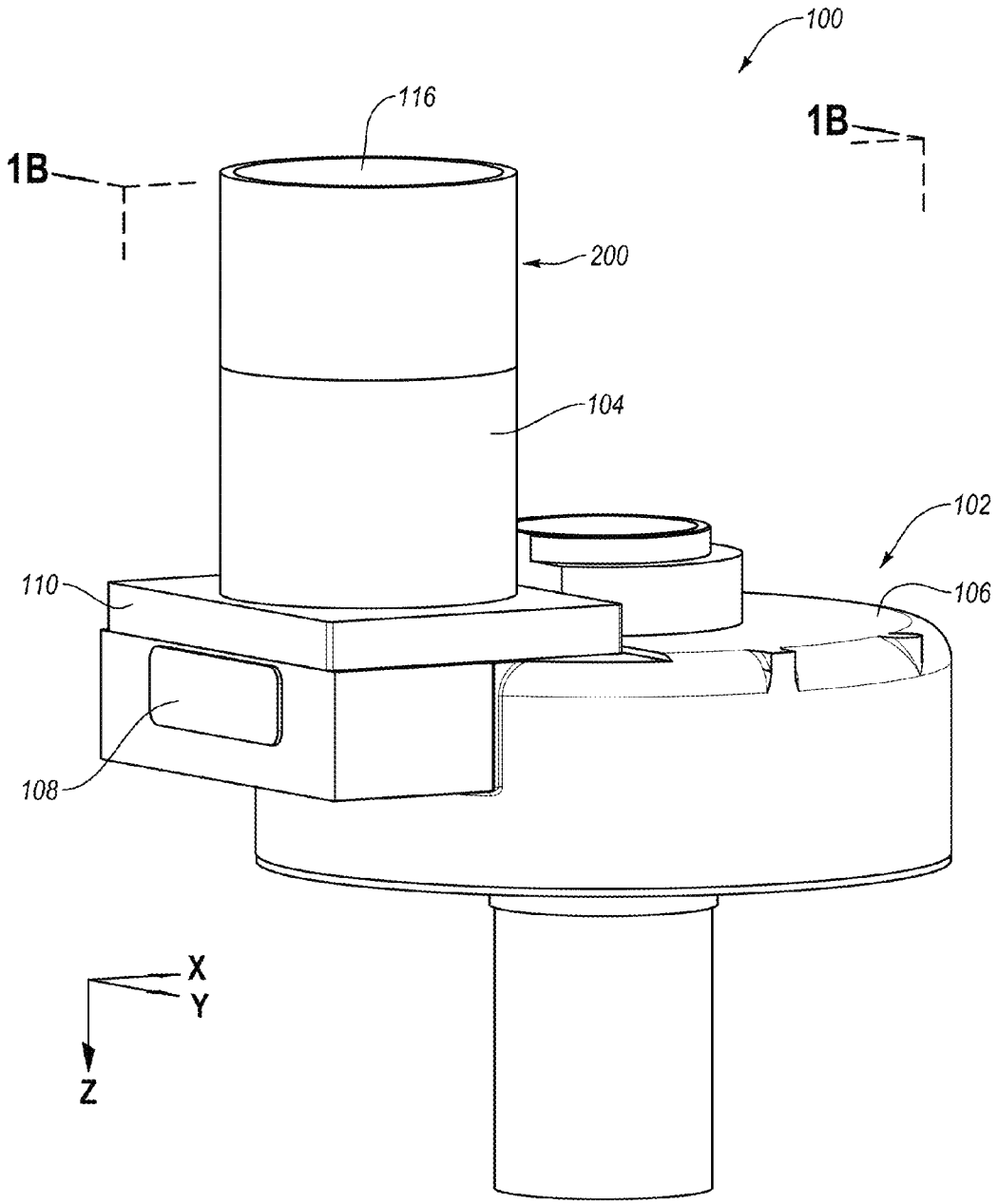
FIG. 1A is a perspective view of an example x-ray tube in which one or more embodiments described herein may be implemented.
Figure 1B:
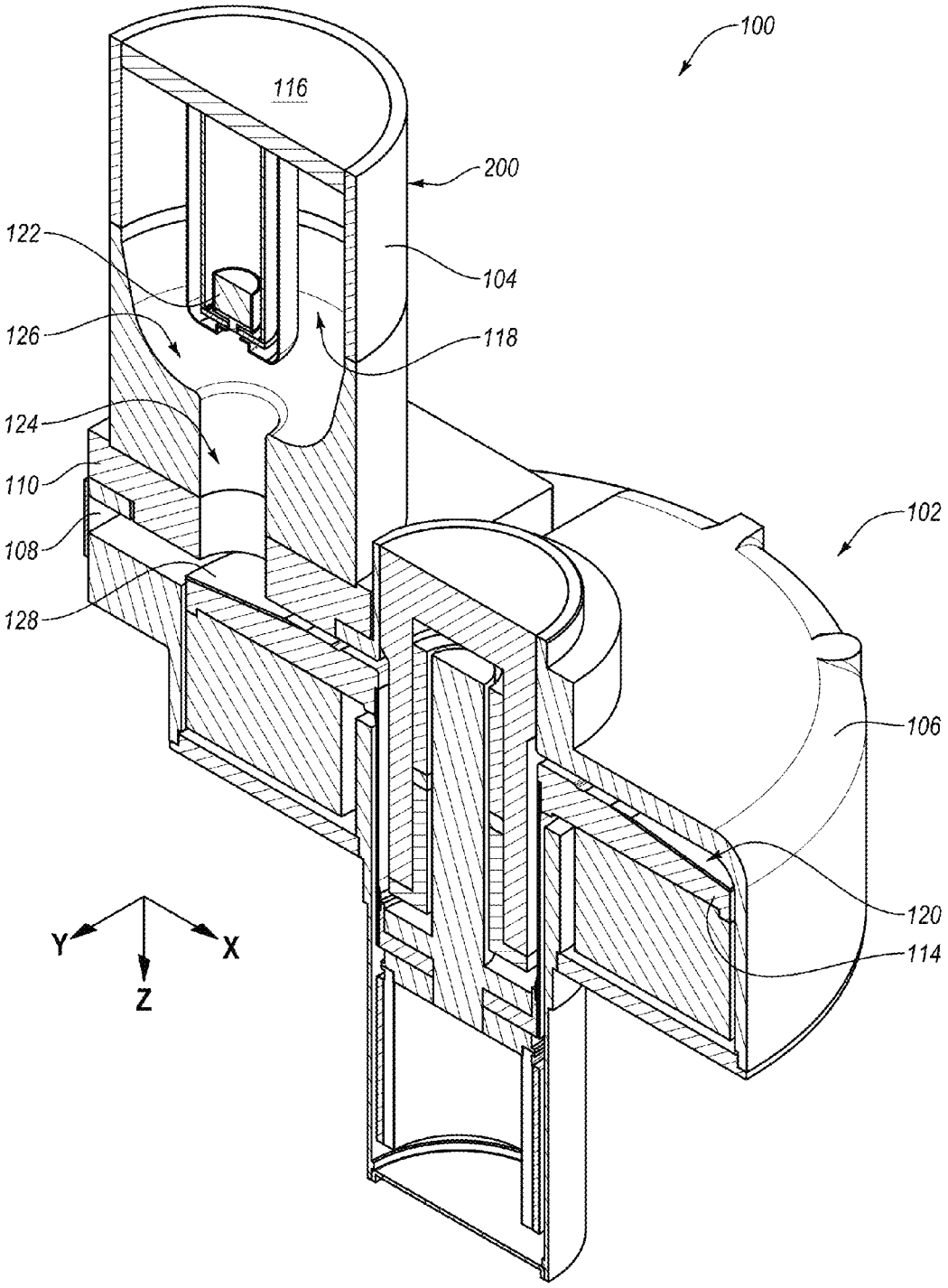
FIG. 1B is a cross-sectional view of the x-ray tube of FIG. 1A.

FIGS. 1A-1B are views of an example x-ray tube 100 in which one or more embodiments described herein may be implemented. Specifically, FIG. 1A depicts a perspective view of the x-ray tube 100 while FIG. 1B depicts a cross-sectional view of the x-ray tube 100. The x-ray tube 100 illustrated in FIGS. 1A and 1B represents an example operating environment and is not meant to limit the embodiments described herein.

Generally, x-rays are generated within the x-ray tube 100, some of which then exit the x-ray tube 100 to be utilized in one or more applications. The x-ray tube 100 may include a vacuum structure 102 which may act as the outer structure of the x-ray tube 100. The vacuum structure 102 may include a cathode envelope 104 and an anode housing 106. The cathode envelope 104 may be secured to the anode housing 106 such that an evacuated cathode volume 118 defined by the cathode envelope 104 and an evacuated anode volume 120 defined by the anode housing 106 are substantially joined.

The x-ray tube 100 depicted in FIGS. 1A and 1B includes an adaptor 110 positioned between the anode housing 106 and the cathode envelope 104. The cathode envelope 104 may be welded, brazed, or otherwise mechanically coupled to the adaptor 110 and then the adaptor 110 may be mechanically coupled to the anode housing 106. Inclusion of the adaptor 110 may allow for increased interchangeability between x-ray tubes 100 and/or enable some variations in dimensions of the x-ray tube 100. In alternative embodiments, the cathode envelope 104 may be received in a socket (not shown) defined in the anode housing 106.

The x-ray tube 100 may also include a window 108. Some of the x-rays that are generated in the x-ray tube 100 may exit the x-ray tube 100 through the window 108. The window 108 may be composed of beryllium or another suitable material.

With specific reference to FIG. 1B, the cathode envelope 104 and the adaptor 110 may be included in a cathode assembly 200. The cathode assembly 200 generally includes components that relate to the generation of an electron beam (not shown). The cathode assembly 200 may also include the components of the x-ray tube between an end 116 of the cathode envelope 104 and an anode 114. For example, the cathode assembly 200 may include an electron emitter 122. When an electrical current is applied to the electron emitter 122, the electron emitter 122 is configured to emit an electron beam into the evacuated cathode volume 118 by thermionic emission.

The cathode assembly 200 may additionally include an acceleration region 126 defined by the cathode envelope 104. The acceleration region 126 may be substantially joined to the evacuated cathode volume 118 and may be positioned adjacent to the electron emitter 122. The electron beam emitted by the electron emitter 122 may enter the acceleration region 126 and then propagate through the acceleration region 126. As the electron beam propagates through the acceleration region 126, the electron beam may accelerate. More specifically, according to the arbitrarily-defined coordinate system included in FIGS. 1A and 1B, the electron beam may accelerate in a z-direction, away from the electron emitter 122 in a direction toward the acceleration region 126.

The cathode assembly 200 may additionally include at least part of a drift region 124 defined by the cathode envelope 104. In this and other embodiments, the drift region 124 may also be at least partially defined in the adaptor 110. The drift region 124 may be defined between the acceleration region 126 and the anode 114. The drift region 124 may be substantially joined to the acceleration region 126 such that the electron beam emitted by the electron emitter 122 may propagate through the acceleration region 126 and then through the drift region 124. In the drift region 124, a rate of acceleration of the electron beam may be reduced from a rate of acceleration in the acceleration region 126. As used herein, the term "drift" describes the propagation of the electron beam through the drift region 124.

The drift region 124 may also be substantially joined with the evacuated anode volume 120. Positioned within the anode housing 106 (i.e., in the evacuated anode volume 120) may be the anode 114. The anode 114 may be spaced apart from and be positioned opposite the cathode assembly 200 at a terminal end of the drift region 124. Generally, the anode 114 may be at least partially composed of a thermally conductive material. For example, the conductive material may include tungsten or molybdenum alloy.

The anode 114 may be configured to rotate as the electron beam emitted from the electron emitter 122 impinges upon a target surface 128 of the anode 114. The target surface 128 is shaped as a ring around the rotating anode 114. The location in which the electron beam impinges on the target surface 128 is known as a focal spot (not shown). Some additional details of the focal spot are discussed below. The target surface 128 may be composed of tungsten or a similar material having a high atomic ("high Z") number. A material with a high atomic number may be used for the target surface 128 so that the material will correspondingly include electrons in "high" electron shells that may interact with the electron beam to generate x-rays.

During operation of the x-ray tube 100, the anode 114 and the electron emitter 122 are connected in an electrical circuit. The electrical circuit allows the application of a high voltage potential between the anode 114 and the electron emitter 122. Additionally, the electron emitter 122 is connected to a power source such that an electrical current is passed through the electron emitter 122 to cause the electron beam to be emitted by thermionic emission. The application of a high voltage differential between the anode 114 and the electron emitter 122 causes the electron beam to propagate through the acceleration region 126 and the drift region 124 towards the target surface 128. Specifically, the high voltage differential causes the electron beam to accelerate through the acceleration region 126 and then drift through the drift region 124. As the electron beam accelerates, the electron beam gains kinetic energy. Upon striking the target surface 128, some of this kinetic energy is converted into electromagnetic radiation having a high frequency, i.e., x-rays. The target surface 128 is oriented with respect to the window 108 such that the x-rays are directed towards the window 108. At least some portion of the x-rays then exits the x-ray tube 100 via the window 108.

Figure 2:
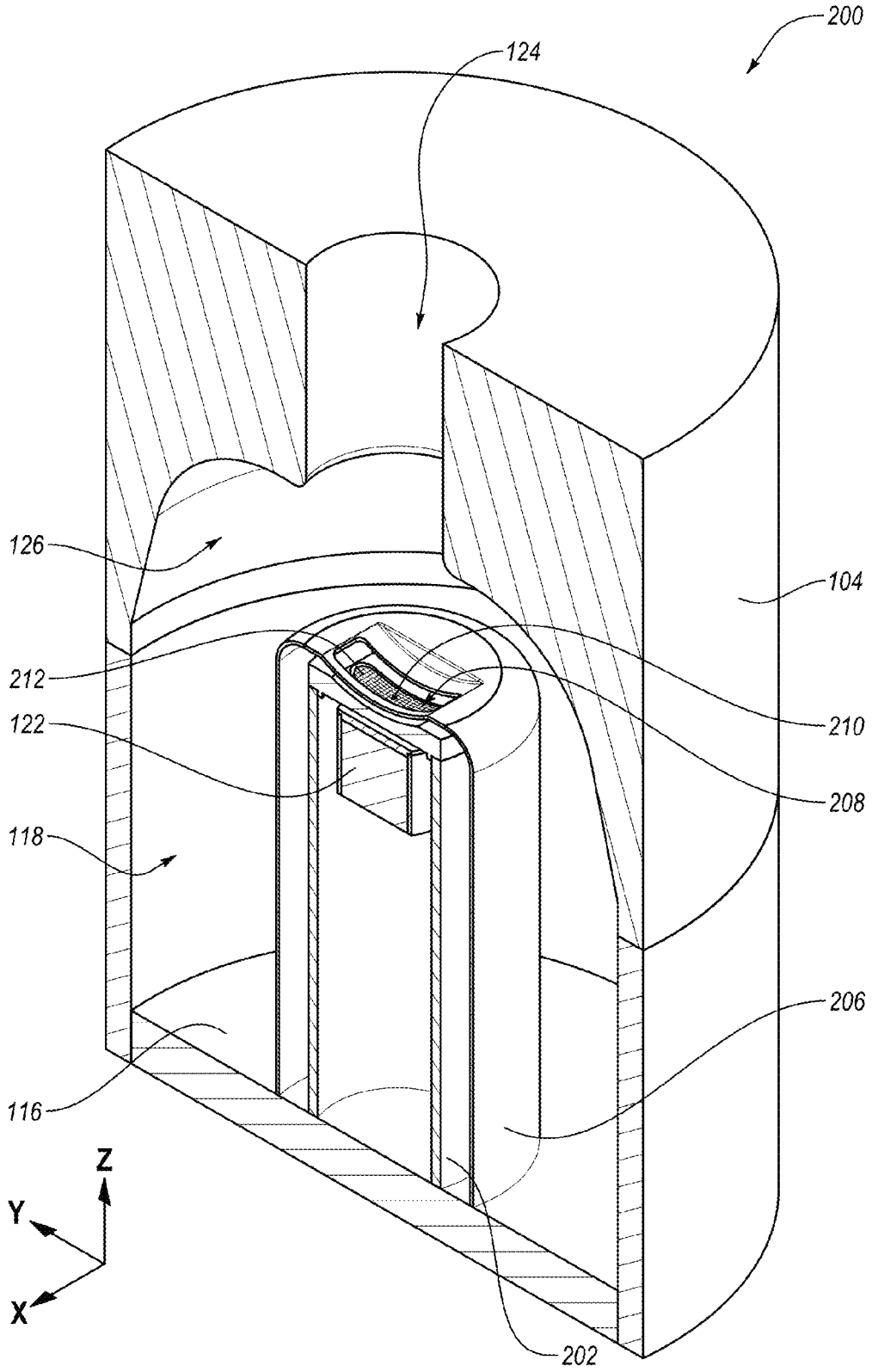
FIG. 2 is a cross-sectional view of portions of an example cathode assembly that may be included in the x-ray tube of FIGS. 1A and 1B.

FIG. 2 is a cross-sectional view of portions of the example cathode assembly 200 that may be included in the x-ray tube 100 of FIGS. 1A and 1B. Specifically, FIG. 2 is a cross-sectional view of the cathode assembly 200 generated using a noncentric plane of the cathode assembly 200.

In the cathode assembly 200, as discussed previously, the cathode envelope 104 defines the evacuated cathode volume 118, the acceleration region 126, and at least a portion of the drift region 124. The electron emitter 122 is positioned within the evacuated cathode volume 118. The cathode assembly 200 may also include a focus structure 202 and a modulating anode 206. In this and other embodiments of the cathode assembly 200, the electron emitter 122 is positioned within the focus structure 202 which is positioned within the modulating anode 206.

The modulating anode 206 may be an example of a modulating control grid. The modulating control grid may be a modulating anode (e.g., the modulating anode 206) or a modulating cathode. Whether to include a modulating anode or a modulating cathode may be based at least partially on the electron emitter 122. When the electron emitter 122 is positively charged, a modulating cathode may be included in cathode assembly 200.

The electron emitter 122 includes a curved emitting surface 208, which is exposed to the evacuated cathode volume 118 and/or acceleration region 126. The curved emitting surface 208 is configured to emit an electron beam (not shown). The electron beam may be emitted in a positive z-direction, substantially normal to a midpoint 210 of the curved emitting surface 208. The electron beam emitted in the positive z-direction results in the electron beam propagating through the acceleration region 126 and the drift region 124 and exiting the cathode envelope 104 (see FIG. 1B).

The focus structure 202 may be configured to focus the electron beam emitted from the curved emitting surface 208. For example, the focus structure 202 may apply an electric field to the electron beam. Emitting the electron beam through the electric field imposes a force to the electron beam, thereby focusing the electron beam. Additionally, the focus structure 202 may be configured to at least partially support the electron emitter 122.

As mentioned above, the focus structure 202 and the electron emitter 122 may be positioned within the modulating anode 206. The modulating anode 206 may be configured to apply an adjustable voltage potential bias to the electron beam as the electron beam is emitted from the curved emitting surface 208. By applying the adjustable voltage potential bias to the electron beam, the modulating anode 206 may influence the electron beam. For example, the modulating anode 206 may accelerate the electron beam away from the curved emitting surface 208, may modify dimensions of the electron beam, may reduce the intensity or number of electrons in the electron beam, or some combination thereof.

Additionally or alternatively, the cathode assembly 200 may include a bias grid 212 positioned adjacent to the curved emitting surface 208. As used herein with respect to the bias grid 212, the phrase "adjacent to the curved emitting surface 208" refers to a surface of the bias grid 212 that is positioned against or near the curved emitting surface 208. The bias grid 212 may be configured to apply a voltage potential bias to the electron beam and thereby modulate the dimensions of the electron beam and/or control emission of the electron beam (e.g., by turning the electron beam "on" and "off").

Figure 3A:
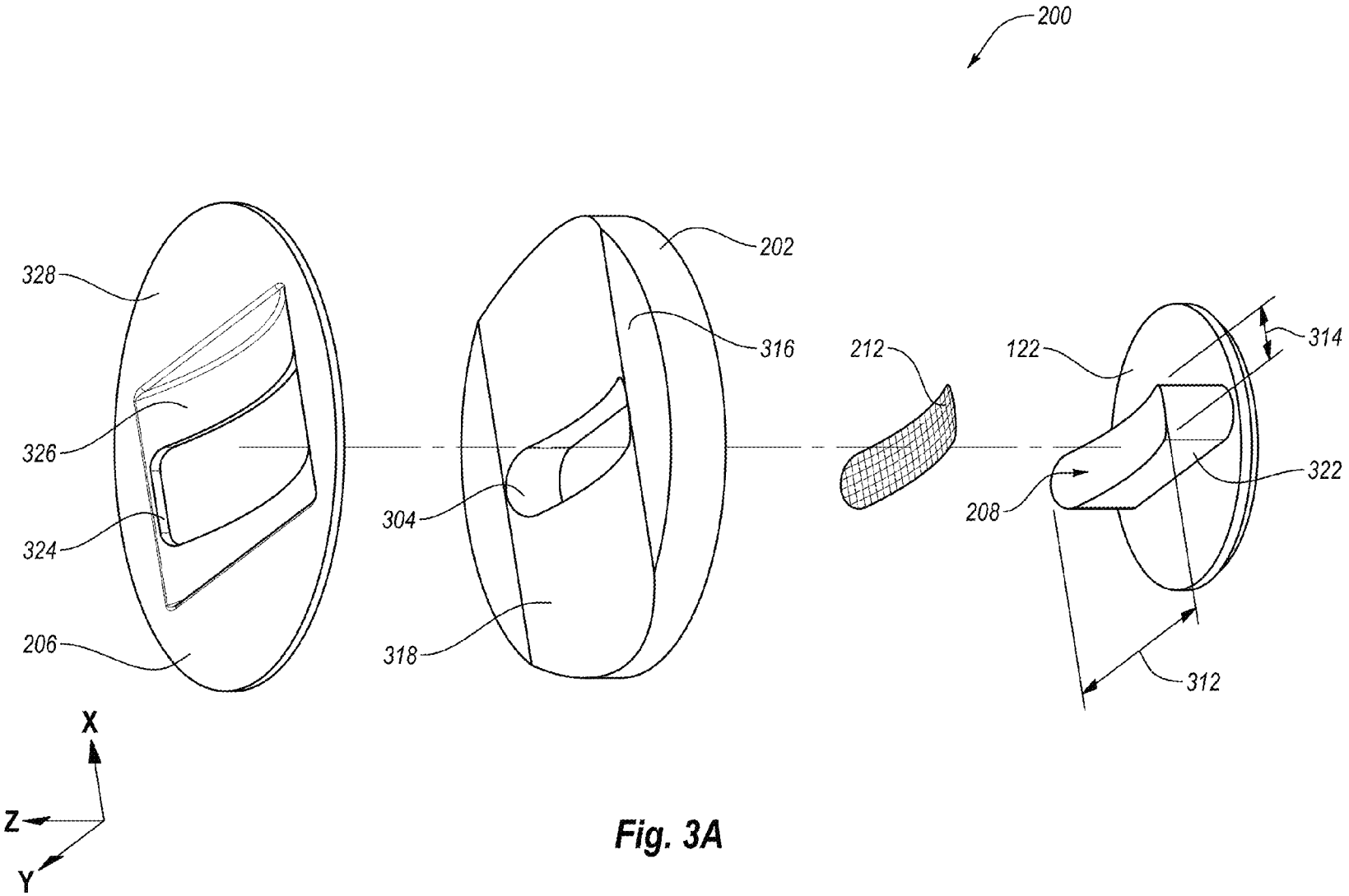
FIG. 3A is an exploded view of other portions of the cathode assembly of FIG. 2.

FIG. 3A is an exploded view of another portion of the cathode assembly 200 that may be included in the x-ray tube 100 of FIGS. 1A and 1B. FIG. 3A illustrates a portion of the modulating anode 206, a portion of the focus structure 202, the bias grid 212, and a portion of the electron emitter 122 exploded in a z-direction. The electron emitter 122 may include a raised portion 322. The top of the raised portion 322 is the curved emitting surface 208. The curved emitting surface 208 generally includes two dimensions: one oriented along a y-axis (the y-dimension 312) and another oriented along an x-axis (the x-dimension 314) of the arbitrarily defined coordinate system shown in FIG. 3A. The y-dimension 312 of the curved emitting surface 208 may be greater than the x-dimension 314 of the curved emitting surface 208.

When the electron emitter 122 is emitting the electron beam (not shown), the electron beam may include a substantially similar y-dimension and a substantially similar x-dimension to the y-dimension 312 and the x-dimension 314, respectively, of the curved emitting surface 208. Thus, at the curved emitting surface 208 of the electron emitter 122, the electron beam may have a y-dimension that is greater than an x-dimension.

With combined reference to FIGS. 2 and 3A, the y-dimension and the x-dimension of the electron beam may be modified by the modulating anode 206 and/or the bias grid 212. For example, at the curved emitting surface 208, the electron beam may include a y-dimension substantially similar to the y-dimension 312 of the electron emitter 122 Likewise, at the curved emitting surface 208, the electron beam may include an x-dimension substantially similar to the x-dimension 314 of the electron emitter 122. Thus, the y-dimension of the electron beam may be greater than the x-direction of the electron beam at the curved emitting surface 208. However, the modulating anode 206 and/or the bias grid 212 may apply a voltage potential bias to modify the y-dimension and the x-dimension of the electron beam such that the y-dimension and the x-dimension of the electron beam are different from the y-dimension 312 and the x-dimension 314 of the electron emitter 122.

The focus structure 202 depicted in FIG. 3A includes an outer portion 316 and a curved portion 318. Within the curved portion 318, the focus structure 202 defines an opening 304.

In this and other embodiments, the opening 304 is configured to receive the electron emitter 122 or at least some portion of the raised portion 322. Accordingly, dimensions of the opening 304 may be sized to receive the raised portion 322. Additionally, the opening 304 and/or the raised portion 322 may be sized such that the curved emitting surface 208 is flush with the curved portion 318 of the focus structure 202. Alternatively, the opening 304 and/or the raised portion 322 may be sized such that the curved emitting surface 208 is recessed from or extending from the curved portion 318 of the focus structure 202.

The modulating anode 206 may include a curved portion 326 and an outer portion 328. The curved portion 326 may substantially conform to the curved portion 318 of the focus structure 202. Additionally, an anode opening 324 may be defined in the curved portion 326 of the modulating anode 206. The anode opening 324 may be sized greater than the opening 304 defined in the focus structure 202.

Figure 3B:
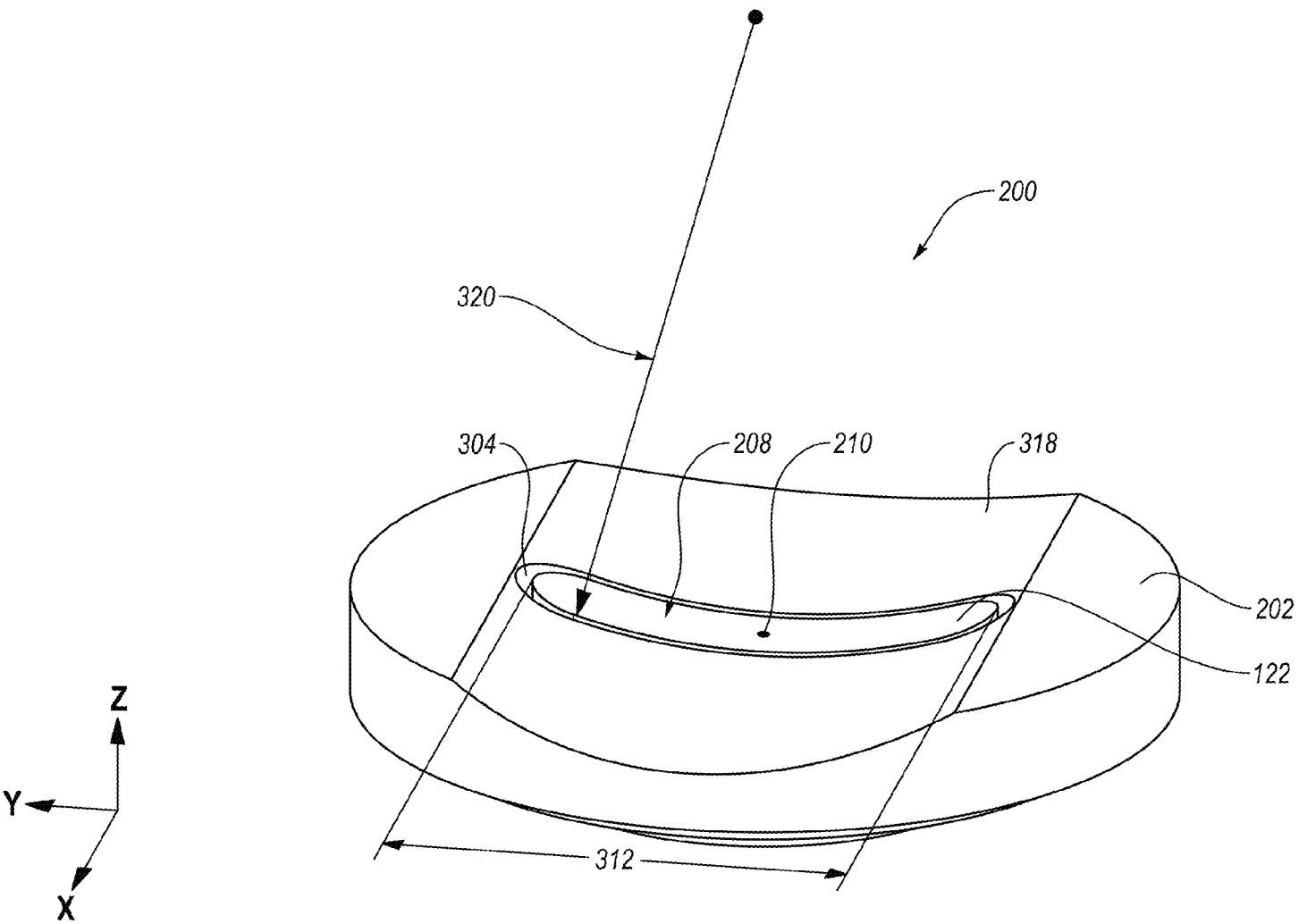
FIG. 3B is an assembled view of the portion of the cathode assembly of FIG. 3A.

FIG. 3B is an assembled view of the portion of the cathode assembly 200 of FIG. 3A. FIG. 3B depicts the electron emitter 122 assembled within the focus structure 202 and without the modulating anode 206. In this and other embodiments, when assembled, the raised portion 322 (see FIG. 3A) may be received in the opening 304. In addition, the curved emitting surface 208 may be recessed from the curved portion 318 of the focus structure 202. However, as stated above, in alternative embodiments, the curved emitting surface 208 may be flush with or extend from the curved portion 318 of the focus structure 202.

FIG. 3B includes a defined curvature represented by an arrow 320. Generally, the defined curvature may be a radius of curvature that best fits a curve at a point or set of points. The defined curvature 320 may be applicable to any curved geometry of the curved emitting surface 208, not limited to spherical or circular geometries. That is, the curved emitting surface 208 may include defined curves 320 including parabolic curves, hyperbolic curve, elliptical curves, etc. In this and other embodiments, the defined curvature 320 of the curved emitting surface 208 and the curved portion 318 of the focus structure 202 may be about equivalent. That is, the focus structure 202 is curved according to the same defined curvature as the curved emitting surface 208.

Additionally, the curve of the curved emitting surface 208 and the curved portion of the focus structure 202 may be substantially continuous in a y-direction (i.e., along the y-dimension 312). Thus, the curve of the curved emitting surface 208 may result in the midpoint 210 of the curved emitting surface 208 having a smaller z-coordinate than all other points on the curved emitting surface 208 having a different y-coordinate. Additionally, the curved emitting surface 208 and the curved portion 318 of the focus structure 202 may not be curved in an x-direction. Thus, all points on the curved emitting surface 208 having the same y-coordinate may also have the same z-coordinate.

Figure 4A:
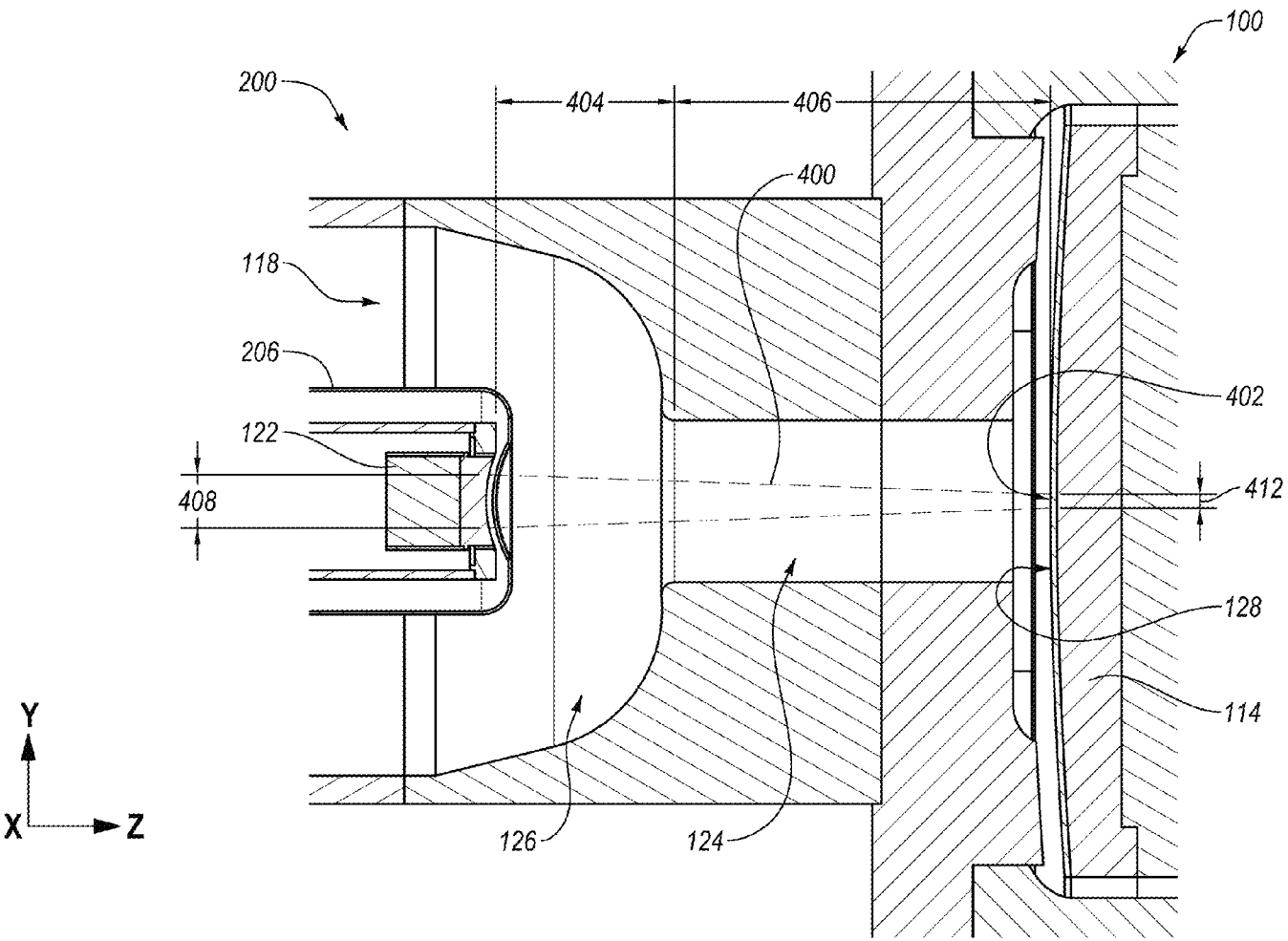
FIGS. 4A and 4B illustrate an example electron beam propagating in the x-ray tube of FIGS. 1A and 1B.
Figure 4B:
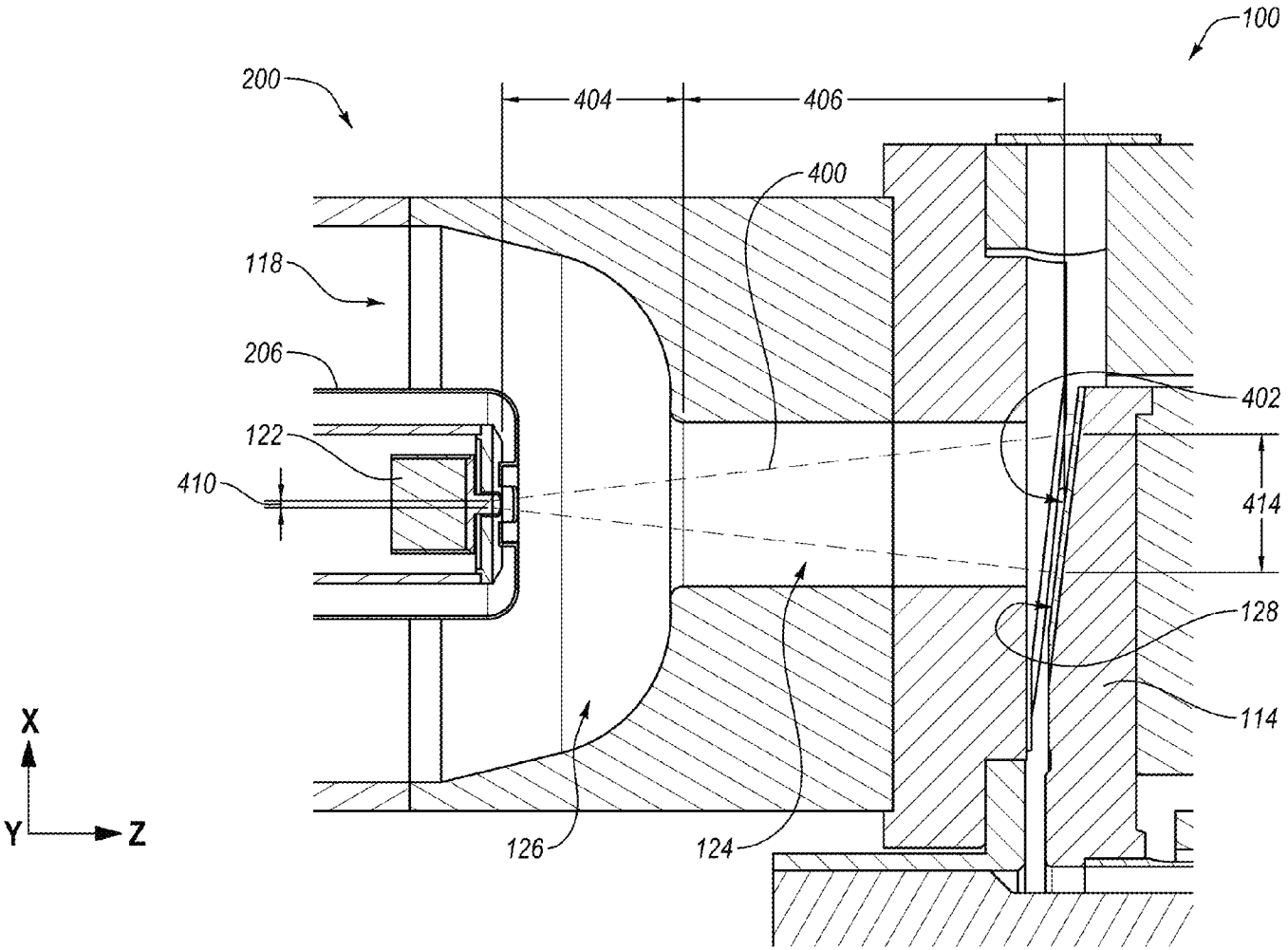

FIGS. 4A and 4B illustrate an example electron beam 400 propagating in the x-ray tube 100 of FIG. 1B. FIG. 4A and FIG. 4B illustrate two sectional views of the electron beam 400 from two perspectives. Specifically, FIG. 4A is aligned in the yz-plane and FIG. 4B is aligned in the xz-plane.

As discussed above, the cathode assembly 200 emits the electron beam 400 towards the anode 114. The electron beam 400 may be substantially laminar. For example, the electron beam 400 may be substantially laminar due to the configuration of the electron emitter 122. The electron beam 400 impinges the target surface 128 to create a focal spot 402. The focal spot 402 is representative of the electron beam 400, or at least a cross section of the electron beam 400, at the target surface 128.

A cross section of the electron beam 400 at the electron emitter 122 includes an x-dimension 410 (FIG. 4B) and a y-dimension 408 (FIG. 4A). The y-dimension 408 may be greater than the x-dimension 410 at the electron emitter 122. In some embodiments, the x-dimension 410 and the y-dimension 408 of the electron beam 400 may be substantially equal to an x-dimension and a y-dimension of a curved emitting surface (not shown), such as the x-dimension 314 and the y-dimension 312 of the curved emitting surface 208 discussed with reference to FIG. 3A.

The electron beam 400 is emitted in the z-direction into the acceleration region 126 and the drift region 124. The acceleration region 126 may have an acceleration region throw length (acceleration length) 404 and the drift region 124 may have a drift region throw length (drift length) 406. Thus, the electron beam 400 propagates through a combination of the acceleration length 404 and the drift length 406 between the electron emitter 122 and the anode 114. This combination of the acceleration length 404 and the drift length 406 may be considered as the "throw length" of the x-ray tube 100 and may be sufficient to categorize the x-ray tube 100 as a "long throw length" x-ray tube.

As the electron beam 400 propagates through the acceleration region 126 and the drift region 124, the y-dimension 408 of the electron beam 400 may decrease while the x-dimension 410 of the electron beam 400 may increase. Thus, at the target surface 128, a y-dimension 412 (FIG. 4A) of the focal spot 402 may be less than an x-dimension 414 (FIG. 4B) of the focal spot 402, which again is representative of dimensions of the electron beam 400.

Additionally, in some embodiments, the combined throw lengths (i.e., the drift length 406 combined with the acceleration length 404) are sufficient for the y-dimension 408 and the x-dimension 410 to substantially transpose between the curved emitting surface (not shown) of the electron emitter 122 and the anode 114. For example, the y-dimension 408 may be about equal to the x-dimension 414 and the x-dimension 410 may be about equal to the y-dimension 412.

With combined reference to FIGS. 3B and 4A-4B, the curved emitting surface 208 may emit the electron beam 400 that impinges upon the target surface 128 to generate the focal spot 402. The dimensions of the electron beam 400 and/or the focal spot 402 may be controlled by the defined curvature 320. For example, the longer the defined curvature 320 the flatter the curved emitting surface 208 may be. Accordingly, embodiments with a longer defined curvature 320 may have a decreased rate at which the y-dimension 408 of the electron beam 400 decreases and a decreased rate at which the x-dimension 410 of the electron beam 400 increases.

FIGS. 5A-5F are example simulated focal spots 500A-500F (generally, focal spots 500) that may be generated in the x-ray tube 100 of FIGS. 1A and 1B. FIGS. 5A-5F illustrate that dimensions of the focal spots 500 and, accordingly, dimensions of an electron beam may be controlled in the x-ray tube 100. Specifically, the dimensions of the focal spots 500 may be controlled by varying bias voltages applied through a modulator anode, by varying the current supplied to an electron emitter, by varying a recess between a curved emitting surface and a focus structure, or some combination thereof.

Each of FIGS. 5A-5F includes coordinate axes indicating a y-dimension and an x-dimension of the focal spots 500. The origin of the coordinate axes corresponds with a midpoint of a curved emitting surface from which the electron beam is emitted.

FIGS. 5A-5D resulted from a simulation run including a first set of parameters. The first set of parameters include: a voltage potential between a cathode assembly and an anode of 90,000 volts (V), a work function of 4.52 electron volts (eV), a constant 60 amps per centimeter-squared, degrees Kelvin squared ($A/cm^2K^2$), and a 2800 K emitter temperature. The focal spots 500A-500D are presented as not projected onto a target surface.

Figure 5A:
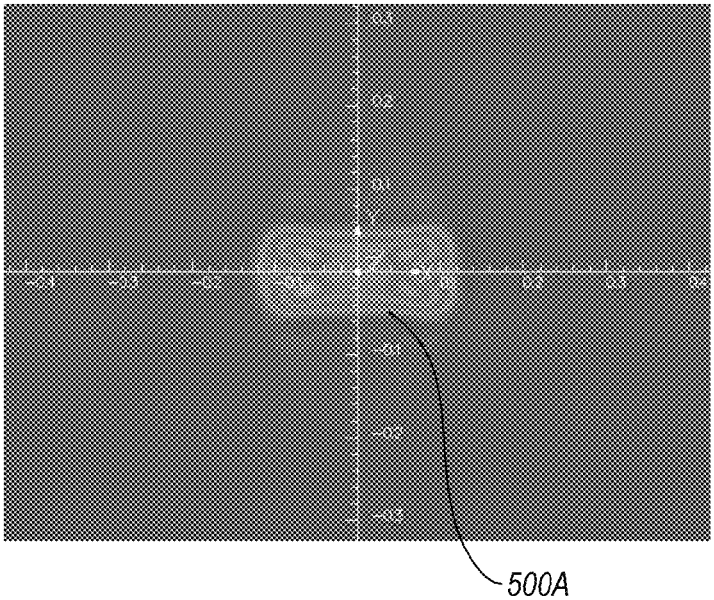
FIGS. 5A-5F are example simulated focal spots that may be generated in the x-ray tube of FIGS. 1A and 1B.
Figure 5B:
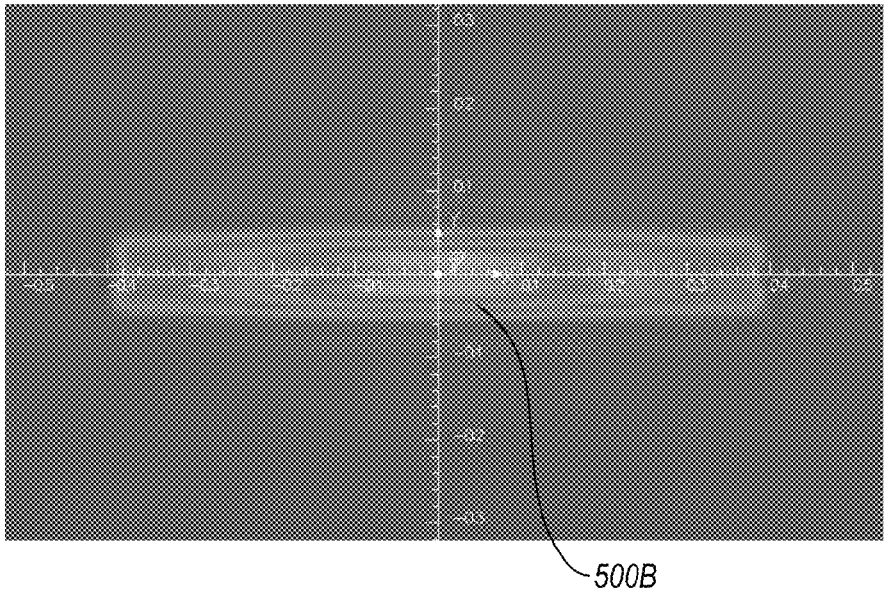

FIG. 5A illustrates a first focal spot 500A resulting from the first set of parameters and a voltage bias (i.e., applied through a modulator anode) of −1000 V and a current provided to the electron emitter of 72 milliamps (mA). FIG. 5B illustrates a second focal spot 500B resulting from the first set of parameters and a voltage bias of −250 V bias and a 587 mA current supplied to the electron emitter. Comparing the first focal spot 500A to the second focal spot 500B illustrates an ability to vary the dimensions of the focal spots 500 by varying the voltage bias and/or the current supplied to the electron emitter.

Figure 5C:
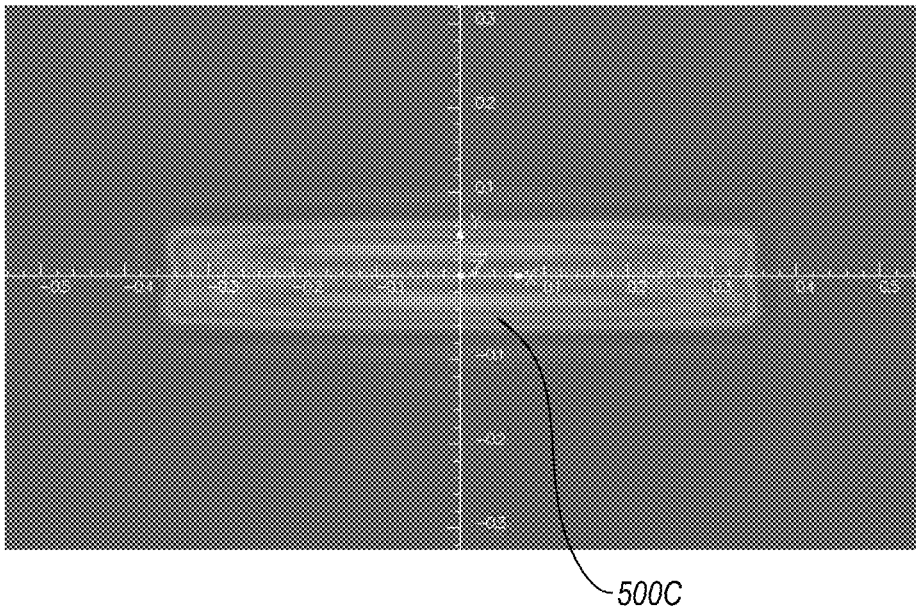
Figure 5D:
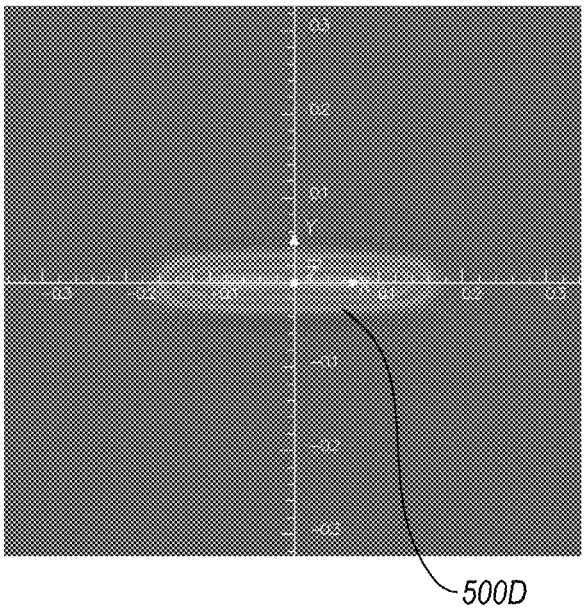

FIG. 5C illustrates a third focal spot 500C resulting from the first set of parameters and a voltage bias of 0V and a 719 mA current supplied to the electron emitter. FIG. 5D illustrates a fourth focal spot 500D resulting from the first set of parameters and a voltage bias of 1000 V and a 719 mA current supplied to the electron emitter. Comparing the third focal spot 500C to the fourth focal spot 500D illustrates an ability to vary the dimensions of the focal spots 500 by varying the bias voltage while maintaining a constant current (i.e., the 719 mA) to the electron emitter.

Figure 5E:
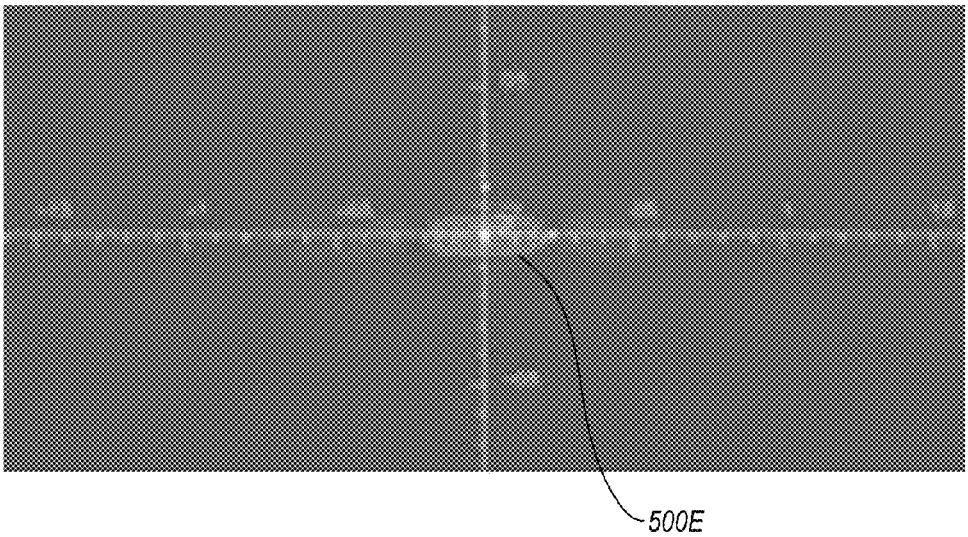
Figure 5F:
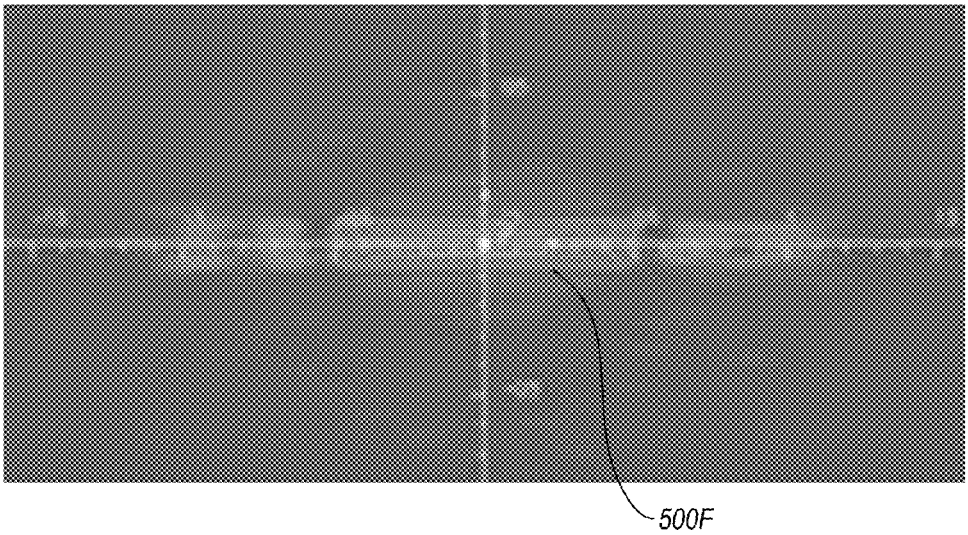

FIGS. 5E and 5F resulted from a simulation run under a second set of parameters. The second set of parameters include: a voltage potential between a cathode assembly and an anode of 120,000 volts (V), a work function of 4.52 eV, a constant 60 $A/cm^2K^2$, and a 2728 K emitter temperature. No bias voltage is applied and the current supplied to the electron emitter is not varied. The focal spots 500E and 500F are presented as not projected onto a target surface.

FIG. 5E illustrates a fifth focal spot 500E that results from the second set of parameters and a curved emitting surface recessed from the focal structure by 0.010 inches. FIG. 5F illustrates a sixth focal spot 500F that results from the second set of parameters and a curved emitting surface extended from the focal structure by 0.005 inches. Comparing the fifth focal spot 500E to the sixth focal spot 500F illustrates a capability of controlling dimensions of the focal spots 500 by varying the recess or position of the curved emitting surface with respect to the focus structure.

Figure 6:
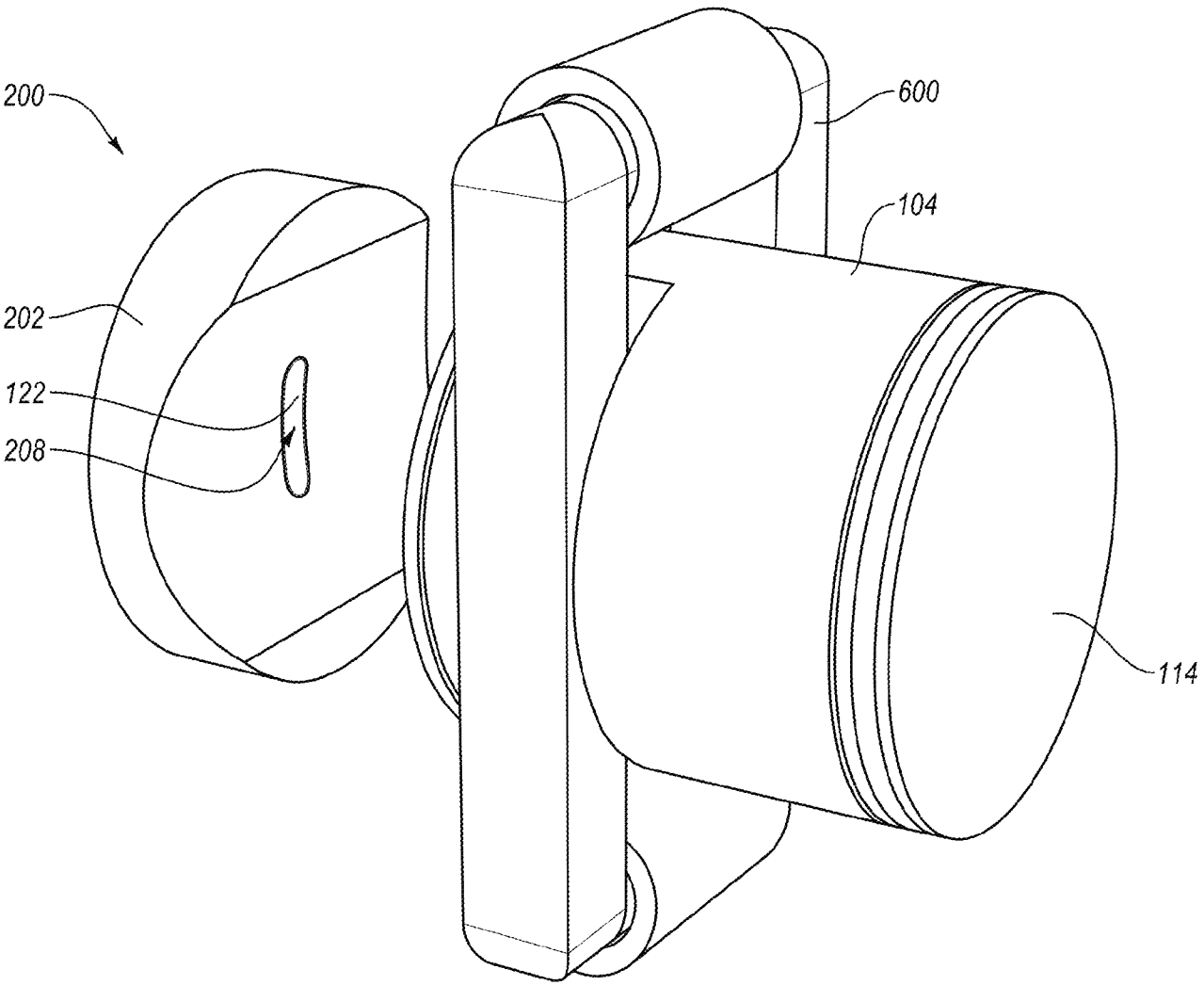
FIG. 6 is a schematic view of an example steering mechanism that may be implemented in the cathode assembly of FIG. 2.

FIG. 6 is an example steering mechanism 600 that may be implemented in the cathode assembly 200 of FIG. 2. As discussed above, the electron emitter 122 positioned in the focus structure 202 may emit an electron beam (not shown) from the curved emitting surface 208. The electron beam may propagate through the cathode envelope 104 to impinge against the anode 114 generating a focal spot (not shown).

The steering mechanism 600 may be positioned relative to a drift region (not shown) defined at least partially by the cathode envelope 104. The steering mechanism 600 may be configured to impose a steering force on the electron beam at least partially while the electron beam propagates through the drift region. The steering force may move or control the position of the focal spot on the target surface 128. For example, the steering force may move the position of the focal spot vertically or horizontally on the target surface 128 of the anode 114. FIG. 6 illustrates an electromagnetic mechanism as the steering mechanism 600. However, in alternative embodiments, the steering mechanism may include an electrostatic mechanism.

Figure 7:
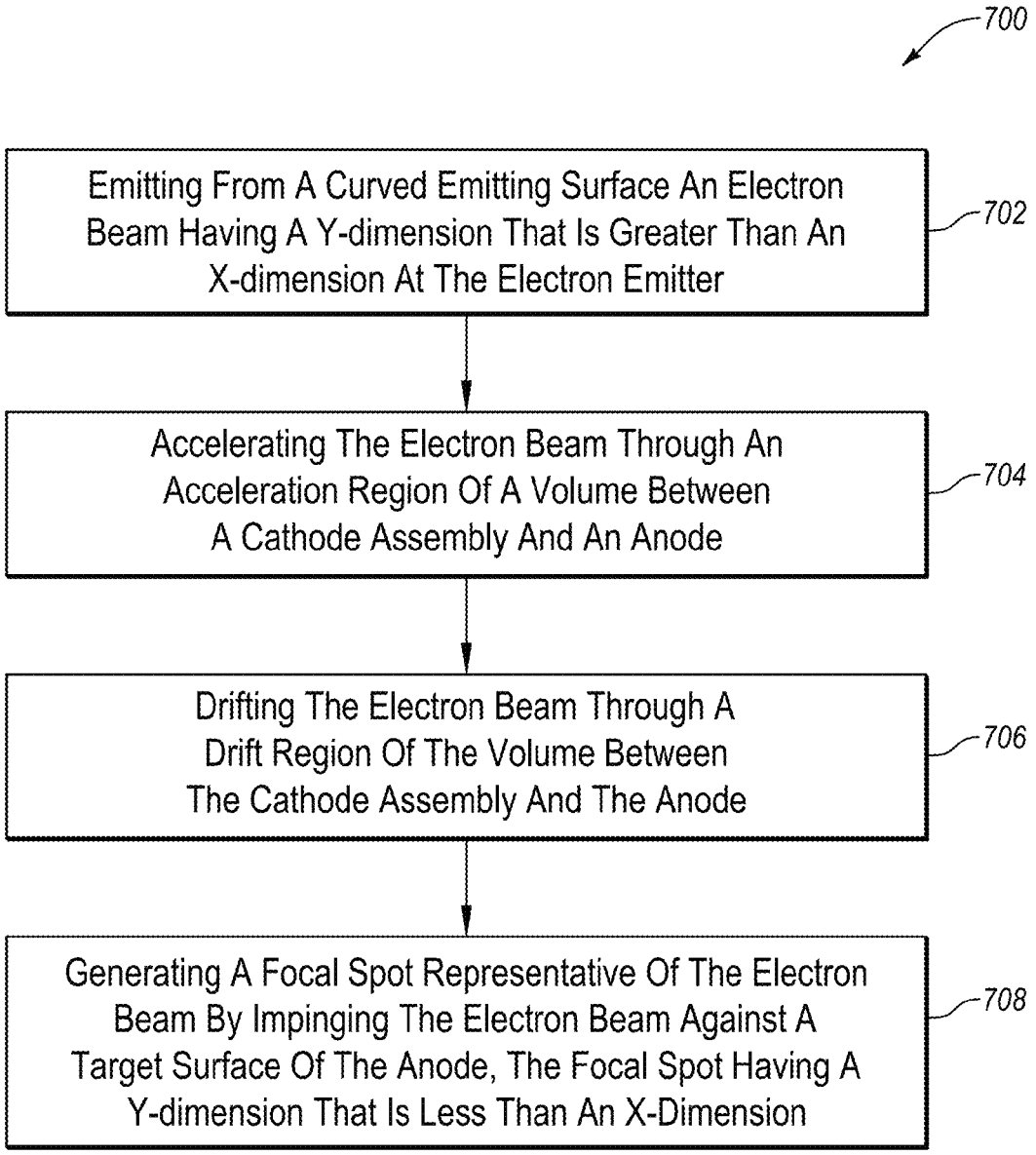
FIG. 7 is a flow diagram of an example method for generating x-rays in an x-ray tube that may be implemented in the x-ray tube of FIGS. 1A and 1B.

FIG. 7 is a flow diagram of an example method 700 for generating x-rays in an x-ray tube that may be implemented in the x-ray tube 100 of FIGS. 1A and 1B. One skilled in the art will appreciate that, for this and other procedures and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the disclosed embodiments.

The method 700 may begin at 702 by emitting from a curved emitting surface an electron beam having a y-dimension that is greater than an x-dimension at the electron emitter. The y-dimension and the x-dimension may be defined relative to a coordinate system oriented such that the electron beam is traveling substantially in the positive z-direction.

At 704, the method 700 may include accelerating the electron beam through an acceleration region of a volume between a cathode assembly and an anode. The acceleration may be at least partially due to a voltage potential between the cathode assembly and the anode. The acceleration of the electron beam may occur at a first rate of acceleration. The cathode assembly may include the curved emitting surface.

At 706, the method 700 may include drifting the electron beam through a drift region of the volume between the cathode assembly and the anode. By drifting, the electron beam may be accelerated at a second rate of acceleration through the drifting region.

At 708, the method 700 may include generating a focal spot representative of the electron beam by impinging the electron beam against a target surface of the anode, the focal spot having a y-dimension that is less than an x-dimension. Dimensions of the focal spot may be due to transposition of the dimensions of the electron beam as it passes through the acceleration region and the drift region.

In some embodiments, the y-dimension and the x-dimension of the focal spot are controlled by a defined curvature of the curved emitting surface and/or a recess depth of the curved emitting surface from a curved focus structure. Additionally or alternatively, in some embodiments, the method 700 may include controlling the y-dimension and the x-dimension of the focal spot by applying a voltage potential bias to the electron beam using a modulating anode, by applying a voltage potential bias to the electron beam using a bias grid, or by varying a current applied to the curved emitting surface while emitting the electron beam.

Additionally or alternatively, in some embodiments, the method 700 may include controlling the position of the focal spot on the target surface by imposing a steering force to the electron beam while the electron beam is drifting through the drift region. Some examples of the steering force may include an electromagnetic force or an electrostatic force.

The present invention may be embodied in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A cathode assembly for an x-ray tube comprising:

an electron emitter including a curved emitting surface configured to emit an electron beam having a y-dimension that is greater than an x-dimension at the electron emitter;

an acceleration region defined adjacent to the electron emitter and configured such that when the electron beam propagates within the acceleration region, the electron beam accelerates in a z-direction substantially normal to a midpoint of the curved emitting surface; and a drift region defined between the acceleration region and an anode and configured such that the combined lengths of the drift region and the acceleration region are sufficient for the y-dimension of the electron beam to be less than the x-dimension of the electron beam at the anode.

2. The cathode assembly of claim 1, further comprising a curved focus structure defining an opening configured to receive the electron emitter.

3. The cathode assembly of claim 2, wherein the curved focus structure and the curved emitting surface are curved according to a defined curvature.

4. The cathode assembly of claim 3, wherein when the electron emitter is received in the opening, the curved emitting surface is recessed from the curved focus structure.

5. The cathode assembly of claim 1, further comprising a bias grid positioned adjacent to the curved emitting surface, the bias grid configured to apply a voltage potential bias to modify the y-dimension and the x-dimension of the electron beam.

6. The cathode assembly of claim 1, further comprising a modulating anode configured to apply an adjustable voltage potential bias to the electron beam as the electron beam is emitted from the curved emitting surface to modify the y-dimension and the x-dimension of the electron beam.

7. The cathode assembly of claim 6, further comprising a cathode envelope defining an evacuated cathode volume and defining the drift region, the cathode envelope configured to be secured to an anode housing containing the anode.

8. The cathode assembly of claim 1, further comprising a steering mechanism positioned relative to the drift region such that the steering force is imposed on the electron beam as the electron beam propagates through the drift region.

9. The cathode assembly of claim 8, wherein the steering mechanism comprises an electromagnetic mechanism or an electrostatic mechanism.

10. The cathode assembly of claim 1, wherein the combined lengths of the drift region and the acceleration region are sufficient for the y-dimension and the x-dimension to substantially transpose between the electron emitter and the anode.

11. An x-ray tube comprising:

a cathode assembly including an electron emitter and a cathode envelope, the electron emitter having a curved emitting surface configured to emit an electron beam having a y-dimension that is greater than an x-dimension at the electron emitter, the cathode envelope defining a drift region and an acceleration region, the acceleration region positioned relative to the cathode assembly such that the electron beam enters the acceleration region and propagates through the acceleration region and then through the drift region; and an anode positioned opposite the cathode assembly at a terminal end of the drift region, the anode including a target surface upon which the electron beam impinges to generate a focal spot, the focal spot having a y-dimension that is less than an x-dimension.

12. The x-ray tube of claim 11, wherein the y-dimension of the focal spot is substantially similar to the x-dimension of the electron beam at the electron emitter and the x-dimension of the focal spot is substantially similar to the y-dimension of the electron beam at the electron emitter.

13. The x-ray tube of claim 11, further comprising:

a steering mechanism configured to impose a steering force on the electron beam to move the position of the focal spot on the target surface, the steering mechanism positioned relative to the drift region such that the steering force is imposed on the electron beam at least partially while the electron beam is propagating through the drift region.

14. The x-ray tube of claim 13, wherein the steering mechanism comprises an electrostatic mechanism or an electromagnetic mechanism.

15. The x-ray tube of claim 11, further comprising a curved focus structure configured to support the electron emitter such that the curved emitting surface is recessed from the curved focus structure, wherein the curved focus structure and the curved emitting surface are curved according to a defined curvature.

16. The x-ray tube of claim 11, further comprising a bias grid positioned adjacent to the emitting surface or a modulating anode, the bias grid or the modulating anode configured to modify the y-dimension of the focal spot and the x-dimension of the focal spot.

17. A method of generating x-rays in an x-ray tube, the method comprising:

emitting from a curved emitting surface an electron beam having a y-dimension that is greater than an x-dimension at the electron emitter;

accelerating the electron beam through an acceleration region of a volume between a cathode assembly and an anode;

drifting the electron beam through a drift region of the volume between the cathode assembly and the anode; and generating a focal spot representative of the electron beam by impinging the electron beam against a target surface of the anode, the focal spot having a y-dimension that is less than an x-dimension.

18. The method of claim 17, wherein the y-dimension and the x-dimension of the focal spot are controlled by:

a defined curvature of the curved emitting surface; and/or a recess of the curved emitting surface from a curved focus structure.

19. The method of claim 17, further comprising controlling the y-dimension and the x-dimension of the focal spot by:

applying a voltage potential bias to the electron beam using a modulating anode;

applying a voltage potential bias to the electron beam using a bias grid; or varying a current applied to the curved emitting surface while emitting the electron beam.

20. The method of claim 17, further comprising controlling the position of the focal spot on the target surface by imposing a steering force to the electron beam while the electron beam is drifting through the drift region, the steering force comprising an electromagnetic force or an electrostatic force.

* * * * *